United States Patent [19]

Cacioppo et al.

[11] Patent Number: 4,739,689

[45] Date of Patent: Apr. 26, 1988

[54] THUMB REST FOR STRINGED MUSICAL INSTRUMENT

[75] Inventors: Tom Cacioppo, 10 Burnside Ave.; Tony Karl, Jr., c/o Anka Tool & Die, 150 Wells Ave., both of Congers, N.Y. 10920

[73] Assignees: Thomas Cacioppo; Tony Karl, Jr., both of Congers, N.Y. ; a part interest to each

[21] Appl. No.: 60,930

[22] Filed: May 15, 1987

[51] Int. Cl.[4] ..... G10D 3/18

[52] U.S. Cl. ..... 84/328; 84/453; 84/465

[58] Field of Search ..... 84/267, 278–281, 84/328, 453, 465

[56] References Cited

U.S. PATENT DOCUMENTS

| | | | |
|---|---|---|---|
| D. 278,155 | 3/1985 | Peavey et al. | D17/20 |
| 925,068 | 6/1909 | Ziegler | 84/279 |
| 1,017,448 | 2/1912 | Nelson | 84/328 |
| 1,125,262 | 1/1915 | Bohmann | 84/328 |
| 1,785,206 | 12/1930 | Overton | 84/328 |
| 1,937,025 | 11/1933 | Loomis | 84/385 |
| 3,375,747 | 4/1968 | Posey | 84/453 |
| 3,783,731 | 1/1974 | Pash | 84/173 |

FOREIGN PATENT DOCUMENTS

| | | | |
|---|---|---|---|
| 327389 | 10/1920 | Fed. Rep. of Germany | 84/328 |

*Primary Examiner*—Lawrence R. Franklin

*Attorney, Agent, or Firm*—Ostrolenk, Faber, Gerb & Soffen

[57] ABSTRACT

A player's finger rest for the body of a guitar, or the like, includes a slide having a slideway oriented generally along the length of the strings, and a pivotable finger lever supported on a pivot shaft which is movable along the slideway, whereby the finger lever may be moved to a desired position along the slideway and may be pivoted to a desired orientation with respect to the slideway. A nut is tightened down over the pivotable finger support and presses the finger support against a resilient washer which is pressed against the slide. This locks the finger support against being movable along the slideway and also prevents pivoting of the finger support. However, sufficient pressure applied to the finger support will overcome the inhibition to pivoting of the finger support which is normally provided by the resilient element.

13 Claims, 2 Drawing Sheets

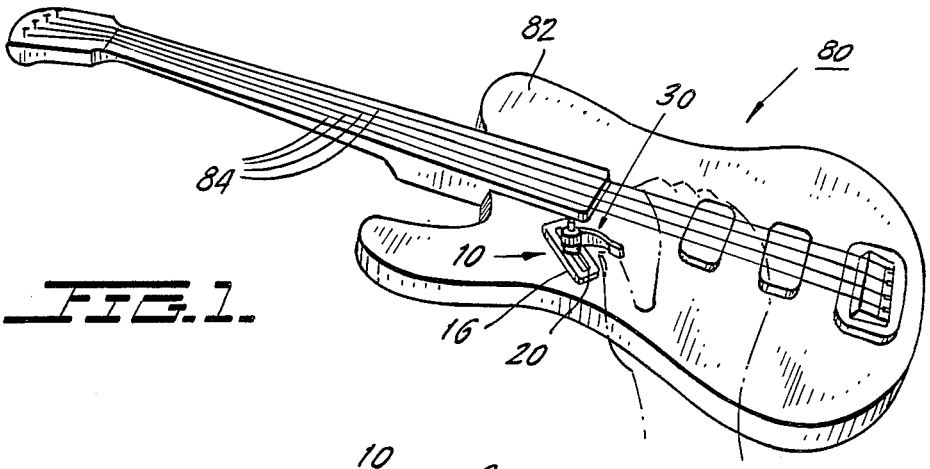
FIG. 1.
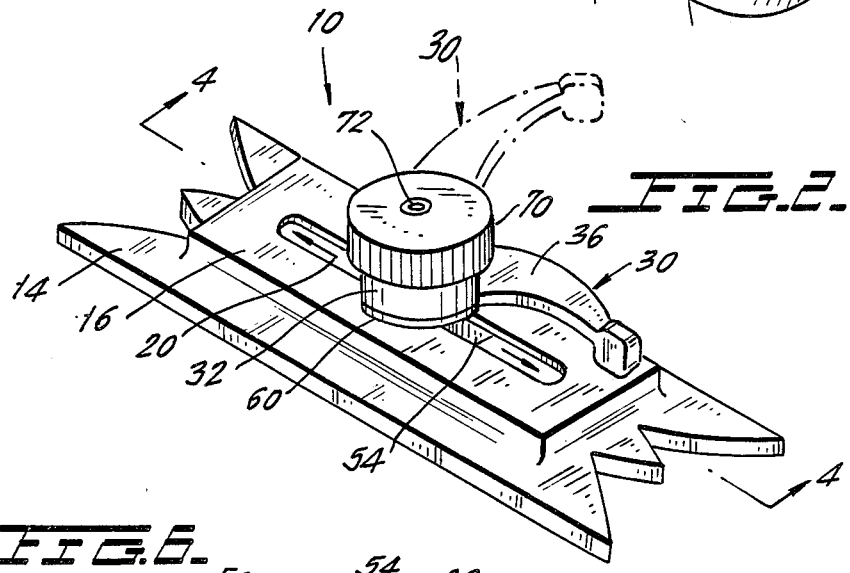
FIG. 2.
FIG. 6.
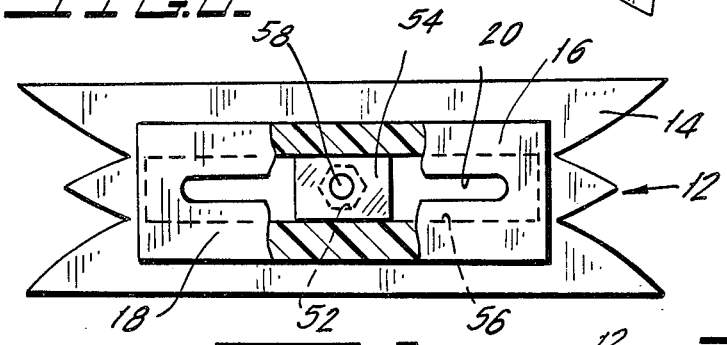
FIG. 7.
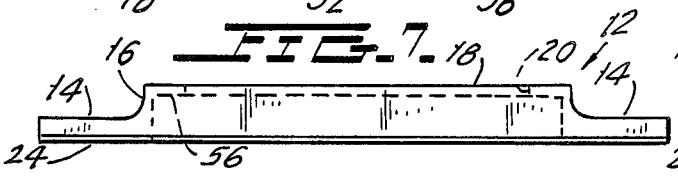
FIG. 8.
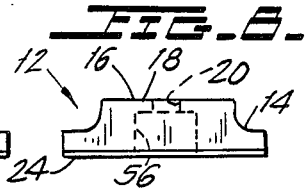

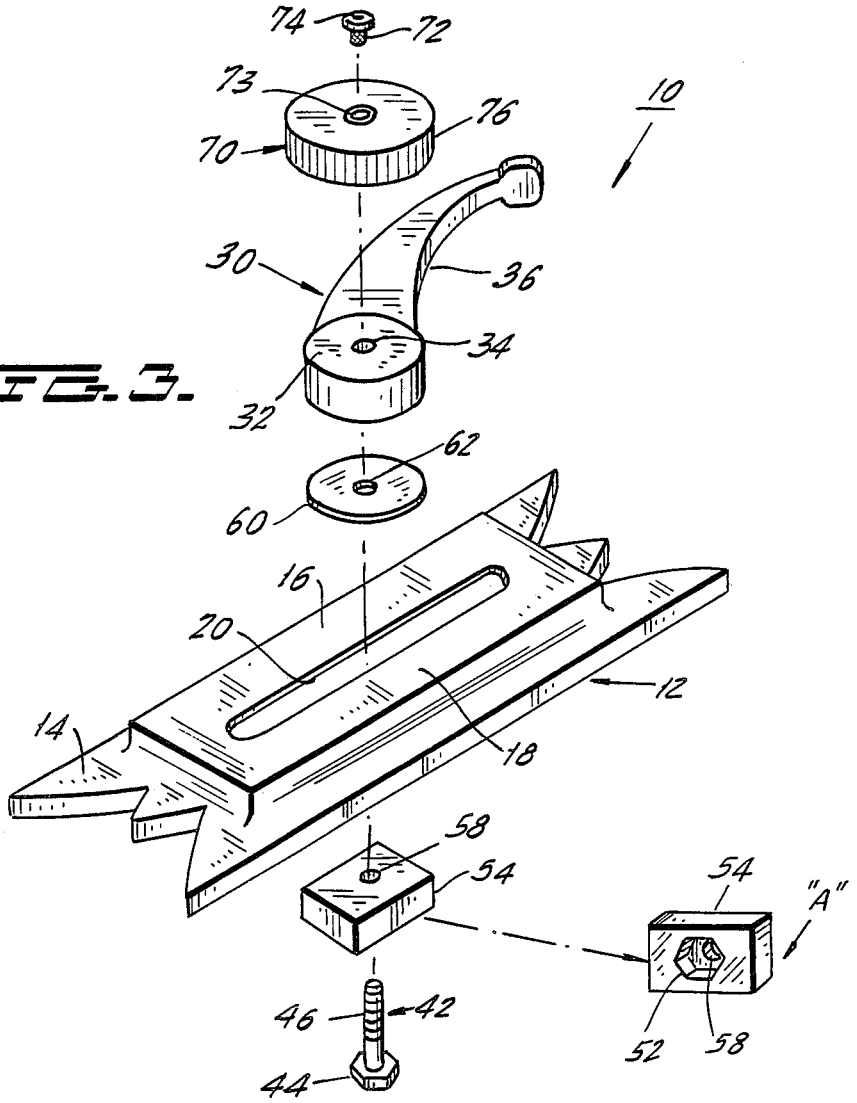
FIG. 3.
FIG. 5.
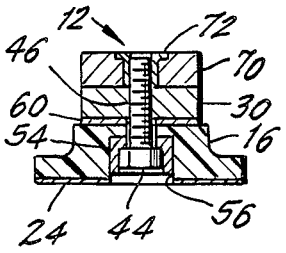
FIG. 4.
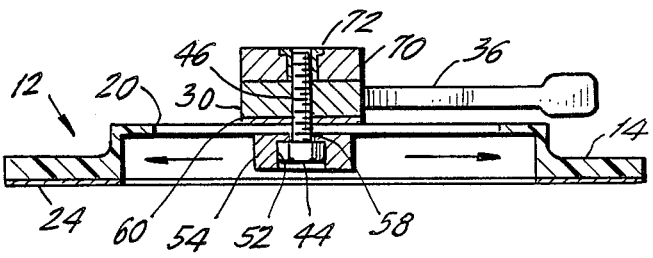

THUMB REST FOR STRINGED MUSICAL INSTRUMENT

BACKGROUND OF THE INVENTION

The invention concerns a thumb rest for a stringed musical instrument, and particularly a guitar, which thumb rest is adjustable in position to accommodate the requirements of a particular player, his comfort, and his technique of playing a particular musical work.

The value of providing a support for the fingers of the player of a stringed musical instrument has been recognized. Various supports are known which are fixedly positioned on the stringed instrument and cannot be adjusted easily to accommodate the requirements of a particular player. Examples of these are shown in U.S. Pat. No. Des. 278,155; U.S. Pat. Nos. 1,017,448 and 1,785,206; and German Pat. No. 327,389.

None of the prior art suggests recognition of the value of a finger or thumb rest for a stringed musical instrument, particularly a guitar, which the player can easily adjust into any selected operative position or out of the way, for comfort or ease in playing a particular musical composition or work. For example, a player's fingers may be differently positioned for playing Spanish music, rock music, classical music, etc., and adjustability of the finger or thumb rest to help in playing each type of music could be valuable.

SUMMARY OF THE INVENTION

Accordingly, it is the primary object of the present invention to provide a rest for use on a stringed musical instrument for the player's hand, more particularly his finger, and more particularly his thumb.

Another object of the invention is to provide such a rest for a guitar.

A primary object of the invention is to provide a finger rest, and particularly a thumb rest, which is adjustable in its position and orientation with respect to the strings of the instrument.

Another object of the invention is to provide such a rest which may be adjusted in a direction generally along the length of the strings of the instrument.

A further object of the invention is to enable adjustment of the position of the rest for rotation around an axis transverse to the direction of extension of the strings.

Yet a further object of the invention is to permit the entire finger or thumb rest to be easily initially applied to the instrument at any desired orientation so that further adjustment will be from that initial orientation.

The invention concerns a finger rest, and particularly a thumb rest to be applied to the body of a stringed musical instrument, and particularly a guitar. The thumb rest includes a slide which includes a slideway or guideway for guiding the movement of a thumb support or lever of the thumb rest along the body of the guitar. At his option, the player may arrange the slideway so that it guides the thumb lever either along the length of the guitar strings or in an oblique direction having a component along that length.

A finger lever or support for the finger, and particularly for the thumb, hereinafter called the thumb lever, is supported on the slide and is movable along the slideway to positions along the slideway, again selected at the convenience of the player. Preferably, the thumb lever is also adjustable in its orientation with respect to the orientation of the slideway, particularly by being pivotable around a pivot on the slide. The location of the pivot along the length of the slideway is movable for moving the thumb lever along the slide.

To the underside of the slide are applied attaching means for removably attaching the slide to the body of the guitar. One form of attaching means comprise adhesive tape, and particularly double sided adhesive tape. Other appropriate attaching means might, of course, be used.

For supporting the thumb lever to the slideway, a pivot shaft is provided which extends from the thumb lever into the slide. Appropriate means tighten the thumb lever to the slide to cause frictional engagement between the thumb lever and the slide and to inhibit pivoting of the thumb lever, once a preferred orientation is selected for the thumb lever. In the preferred embodiment, that tightening means comprises a resilient element disposed in the connection path between the pivot shaft, on the one hand, and the thumb lever, on the other hand, and particularly between the thumb lever and the slideway. That resilient element is deformable by pressure to enable the thumb lever to be pivoted despite the frictional resistance to pivoting. This enables the thumb lever to be pivoted to an out of use position, if the player does not wish to use it, or to be pivoted to a different orientation, without first loosening the tightening means.

In particular, the slide includes a plate in which the slideway is defined. The pivot shaft extends from beneath the plate, past the plate, past the resilient element to the thumb lever which is disposed above that element. A nut above the thumb lever is tightened down on the shaft to tighten the thumb lever against the resilient element to prevent pivoting.

Other objects and features of the present invention will become apparent from the following description of a preferred embodiment of the invention considered in conjunction with the accompanying drawings.

BRIEF DESCRIPTION OF THE DRAWINGS

FIG. 1 is a view of the guitar to which a thumb rest is secured;

FIG. 2 is a top perspective view of the thumb rest;

FIG. 3 is an exploded perspective view of the thumb rest;

FIG. 4 is a longitudinal sectional view thereof along the arrows 4 in FIG. 2;

FIG. 5 is a transverse cross-sectional view thereof;

FIG. 6 is a top view of the slide of the thumb rest partly in cross-section; and FIG. 7 is a longitudinal section of the slide; and FIG. 8 is a transverse section of the slide.

DESCRIPTION OF A PREFERRED EMBODIMENT

The thumb rest 10 of the present invention comprises a slide 12 which includes a peripheral base 14 which extends around the entire slide 12. There is an upraised portion 16 inward of the peripheral base which includes a thin plate section 18 which is opened along its length to define an elongate, straight slideway and guide slot 20. The slideway slot provides a pathway for guiding the movement of the thumb lever 30 and the thumb lever support shaft 46 along the length of the slide, as described below. The thumb lever 30 is secured to the plate 18, again as described below.

To the underside of the peripheral base 14, there is applied the means for adhering the slide to the body 82 of a stringed musical instrument 80. That means comprises adhesive tape with opposite adhesive covered sides, one side adhered to the underside of the base 14 and the other side adherable to the body 82 of a guitar 80. The side of the adhesive tape adherable to the body of the guitar may be temporarily covered with release paper which is removed before the slide is applied to the body 82. As shown in FIGS. 3 and 6, the slide base 14 may have virtually any desired shape, so long as it defines a sufficient surface area that the tape layer 24 will adhere to the body 82 sufficiently tightly that the slide will not undesirably fall free of the body of the guitar during use of the thumb lever 30.

Referring to FIG. 1, since the adhesive tape 24 permits the slide 12 to be applied to the body of the guitar by the player at any desired orientation, the slide may be oriented with the slideway 20 generally parallel to the length of the strings 84 of the guitar, or inclined obliquely to the direction of extension of the strings, as in FIG. 7. The latter orientation would cause the thumb lever 30 to be either further from or closer to the strings, depending upon where the thumb lever is disposed along the length of the slideway 20.

The slide 12 defines a support for and guidance of the thumb lever 30. The lever 30 is comprised of a hub 32 with a clearance opening 34 through it of a size to permit through passage of the below described pivot shaft 46. To the hub 32 is affixed the thumb supporting lever 36 which is comfortably curved and contoured to the player's thumb tip. The lever 36 is of a height which is tall enough off the guitar body that the player's thumb may rest upon the lever 36.

For connecting the slide 12 with the thumb lever 30 and for permitting the thumb lever 30 to pivot with respect to the slide, there is a threaded bolt 42 having a hexagonal head 44. The shaft 46 of the bolt defines a pivot axis for the thumb lever 30, which axis extends into the body of the instrument and transversely of the extension of the strings 84 and alongside the strings.

The bolt 42 is inserted, shaft 46 first, through the countersunk hexagonal opening 52 in the base nut 54 which is disposed in the open space guideway 56 provided beneath the plate 18. The base nut 54 is on any desired material, but would be stiff and strong. The base nut 54 has the width of the open space guideway 56 (FIG. 5), so that the base nut positions the shaft 46 against shifting from side to side and generally centers it in the slideway 20. The guideway 56 guides the motion of the nut 54 along the slide. The opening 52 in the base nut 54 is hexagonally shaped to capture the bolt 42 and prevent its rotating, which enables the below described nut 70 to be tightened down on the shaft 46 for securing the thumb lever 30. The narrow diameter top opening 58 through the base nut 54 is wide enough to permit the shaft 46 to pass freely through it, yet narrow enough to hold the bolt head 44 in the base nut.

Disposed immediately above the plate 18 is the stiff, but resilient, washer 60 of an elastomeric material, e.g. of stiff rubber. The washer 60 is engaged by the thumb lever 30 above it and by the slide plate 18 below it. The shaft 46 passes through the clearance opening 62 in the washer 60, and the shaft 46 passes through the clearance opening 34 in the thumb lever 30. When the thumb lever is tightened down against the washer 60, the resilient material of the washer deforms sufficiently to lock the thumb lever from pivoting around the shaft 46. However, because the washer 60 is of resiliently deformable material, if the player wishes to move the thumb lever rapidly out of the way, that is from the solid line to the broken line positions in FIG. 2, without first loosening the below described nut 70, the player can apply sufficient force to the thumb lever, more than the usual force applied during playing. This will overcome the inhibition to rotation of the thumb lever which is provided by the resilient washer and permit the thumb lever to be rotated around the pivot provided by the shaft 46.

Disposed above the thumb lever 30 is a manually tightenable nut 70 which has a central internally threaded insert 72 which is molded into the center opening 73 of the nut so that the threaded insert 72 rotates with the nut. The insert 72 has a threaded opening 74 sized and of a thread shape to be threaded on the shaft 46. The nut 70 is knurled on its periphery 76 for easier gripping. The player tightens the nut 70 down along the shaft 46 to press the thumb lever 30 against the washer 60 and the plate 18, which secures the thumb lever 30 at the selected orientation. This is sufficient to inhibit free pivoting of the thumb lever 30 but would not prohibit all rotation of the lever, since the resilient washer 60 will deform when sufficient force is applied to the lever 30 to enable rotation of the lever, if desired, without first loosening the nut 70. However, there is sufficient friction contact between the washer 60 and the slide 18 to prohibit sliding of the washer 60 and therefore of the shaft 46 and therefore of the lever 30 along the slideway 20 unless the nut 70 is first loosened.

To establish a selected position for the thumb rest 10 on the guitar, the musician first applies the slide 12 to the body 82 of the guitar 80, by the double sided adhesive tape 24, at a desired orientation and position on the body with respect to the instrument strings 84. One such orientation is illustrated in FIG. 1, but any reasonable orientation where the user's finger, particularly his thumb, is supported when he is playing the instrument, could be selected. The nut 70 is loosened sufficiently to permit the player to select both a position of the thumb lever 30 along the slideway 20 and a pivot orientation for the thumb lever. The nut 70 is next tightened sufficiently that it locks the lever 30 against pivoting and locks the shaft 46 against being moved along the slideway 20. Readjustment of these is readily accomplished by the player loosening the nut 70 sufficiently to free the lever 30 to rotate and the shaft 46 to move along the slideway 20. Even without loosening the nut 70, the player can exert sufficient force to pivot the lever 30 against the resistance to such pivoting provided by the washer 60.

Removal of the thumb rest from the body of the guitar is readily accomplished by releasing the means by which the slide is attached to the body of the guitar. Where the slide 12 is held to the guitar by adhesive tape 24, an appropriate means which separates the adhesive, such as a sharp edge, a piece of string, etc., which severs the adhesive layer, is drawn beneath the adhesive tape along the body of the guitar and enables the slide 12 to be lifted free from the body of the instrument. Reapplication of the slide to the same or another instrument would merely require re-adhering the tape or applying a new layer of tape and then adhering the slide to the instrument body.

The present invention therefore provides an effective finger rest and particularly a thumb rest for the player of a stringed musical instrument, such as a guitar, which enables the player to adjust the position of the thumb rest both in the direction having a component along the length of the strings and in a direction around an axis transverse to the direction of extension of the strings, which axis also extends into the body of the guitar.

Although the present invention has been described in connection with a preferred embodiment thereof, many variations will now become apparent to those skilled in the art. It is preferred, therefore, that the present invention be limited not by the specific disclosure herein, but only by the appended claims.

What is claimed is:

1. A finger rest for the body of a stringed musical instrument, the instrument having a body and an array of strings extending over the body;

the finger rest comprising:

a slide affixed to the body of the instrument at one lateral side of and alongside the array of strings on the instrument; the slide including a slideway which defines a pathway alongside the array of strings;

a finger support comprising a lever, the lever having a hub and having a finger supporting surface outward from the hub; at the hub, the finger support is pivotally supported on the slide and is pivotable around a pivot defined on the slide for adjusting the orientation of the support with respect to the orientation of the slideway; the slideway and the hub being so placed that with a player's finger on the supporting surface, other fingers of the same hand of the player may reach the strings; the hub and the finger support also being movable along the slideway to positions along the slideway selected by the player.

2. The finger rest of claim 1, wherein the pivot on the slide is defined on an axis extending transversely to the direction of extension of the strings of the instruments and into the body of the instrument.

3. The finger rest of claim 1, further comprising attaching means for removably attaching the slide to the body of the instrument.

4. The finger rest of claim 3, wherein the attaching means comprise adhesive tape for adhering the slide to the instrument body.

5. The finger rest of claim 4, wherein the attaching means comprises double sided adhesive tape, having one side for adhesion to the slide and having the other side for adhesion to the body of the instrument.

6. The finger rest of claim 1, wherein the finger support is pivotally supported through a pivot shaft extending into the finger support and extending to the slide; means for tightening the finger support to the slide to cause frictional engagement between the finger support and the slide for inhibiting pivoting of the finger support with respect to the slide.

7. The finger rest of claim 6, wherein the tightening means further comprises a resilient element disposed between the finger support and the slide, the resilient element being deformable by pressure, which pressure is developed in pivoting the finger support around the pivot thereof with sufficient force to overcome the frictional resistance to such pivoting provided by the resilient element.

8. The finger rest of claim 7, wherein the slide includes a plate in which the slideway is defined; the pivot shaft extending past the plate; the finger support being disposed above the plate; the shaft passing through the finger support; the tightening means further comprising a nut disposed above the finger support and receiving the shaft, and the nut being tightenable for drawing the shaft; and the nut being tightened for pressing the finger support against the resilient element and the slide when the nut is tightened on the shaft.

9. The finger rest of claim 8, further comprising a guideway beneath the slide and beneath and along the slideway; a base nut disposed in the guideway, and the base nut and the guideway being shaped to guide the base nut for sliding motion along the guideway while blocking rotation of the base nut; the shaft being held in the base nut for prohibiting rotation of the shaft while enabling the shaft to move along the guideway.

10. A finger rest for the body of a stringed musical instrument, the instrument having a body and an array of strings extending over the body, the finger rest comprising:

a finger support affixed to the body of the instrument at one lateral side of and alongside the array of strings over the body, the finger support comprising a lever, the lever having a hub and having a finger supporting surface outward from the hub; the hub being pivotally supported to the body and being pivotable around a pivot defined at the body of the instrument for adjusting its orientation with respect to the orientation of the strings.

11. The finger rest of claim 10, wherein the pivot is defined on an axis extending transversely to the direction of extension of the strings of the instrument and into the body of the instrument.

12. The finger rest of claim 10, wherein the finger support is pivotally supported through a pivot shaft extending into the finger support and the pivot shaft being supported to the body of the instrument; means for tightening the finger support to the body of the instrument to cause frictional engagement between the finger support and the body of the instrument to inhibit pivoting of the finger support with respect to the body of the instrument.

13. The finger rest of claim 12, wherein the tightening means further comprises a resilient element disposed between the finger support and the body of the instrument for being deformable by pressure, which pressure is developed in pivoting the finger support around the pivot thereof with sufficient force to overcome the frictional resistance to such pivoting provided by the resilient element.

* * * * *